United States Patent [19]

Greenhut

[11] Patent Number: 4,718,707

[45] Date of Patent: Jan. 12, 1988

[54] DISPOSABLE WASTE SCOOPER

[75] Inventor: Bart E. Greenhut, Los Angeles, Calif.

[73] Assignee: Petpro Products, Inc., Los Angeles, Calif.

[21] Appl. No.: 922,177

[22] Filed: Oct. 22, 1986

[51] Int. Cl.[4] ..... A01K 29/00; B65D 13/06

[52] U.S. Cl. ..... 294/1.4

[58] Field of Search ..... 294/1.4, 1.3, 55; 15/104.8, 257.1, 257.6; 229/9, 19, 52 AC, 52 AL; 220/252, 345, 346, 351

[56] References Cited

U.S. PATENT DOCUMENTS

| | | | |
|---|---|---|---|
| 3,910,619 | 10/1975 | Schmieler | 294/1.4 |
| 4,037,867 | 7/1977 | Fano et al. | 294/1.4 |
| 4,529,236 | 7/1985 | Vogt | 294/1.3 |

*Primary Examiner*—James B. Marbert

*Attorney, Agent, or Firm*—Freilich, Hornbaker, Rosen & Fernandez

[57] ABSTRACT

A disposable waste scooper is provided for scooping up the feces of dogs into a container and closing the container, the container being of low cost so it can be economically disposed of and the container being remotely closeable so it can be cleanly disposed of. The scooper includes a U-shaped wire frame which holds the opening of a flexible bag. The legs of the u-shaped frame can slide up along a cardboard closing device. After the bottom of the frame is dragged along the ground to scoop up the waste into the bag, the cardboard closing device is pushed down to slide down against the cover to close the bag. One side of the bag opening is fixed to the bottom of the cardboard closing device so the opening of the bag is pressed closed. The entire apparatus is then thrown away.

11 Claims, 7 Drawing Figures

FIG. 1
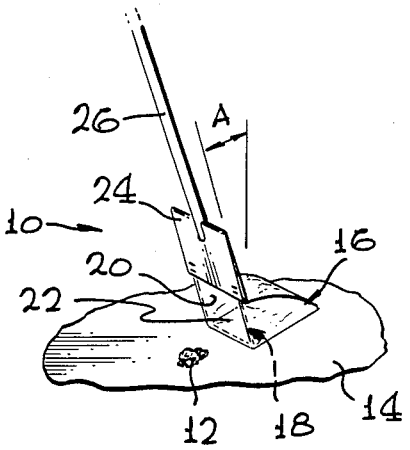
FIG. 2
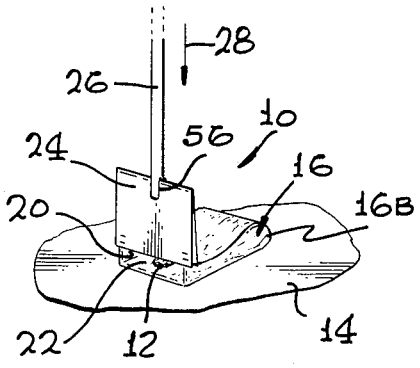
FIG. 3
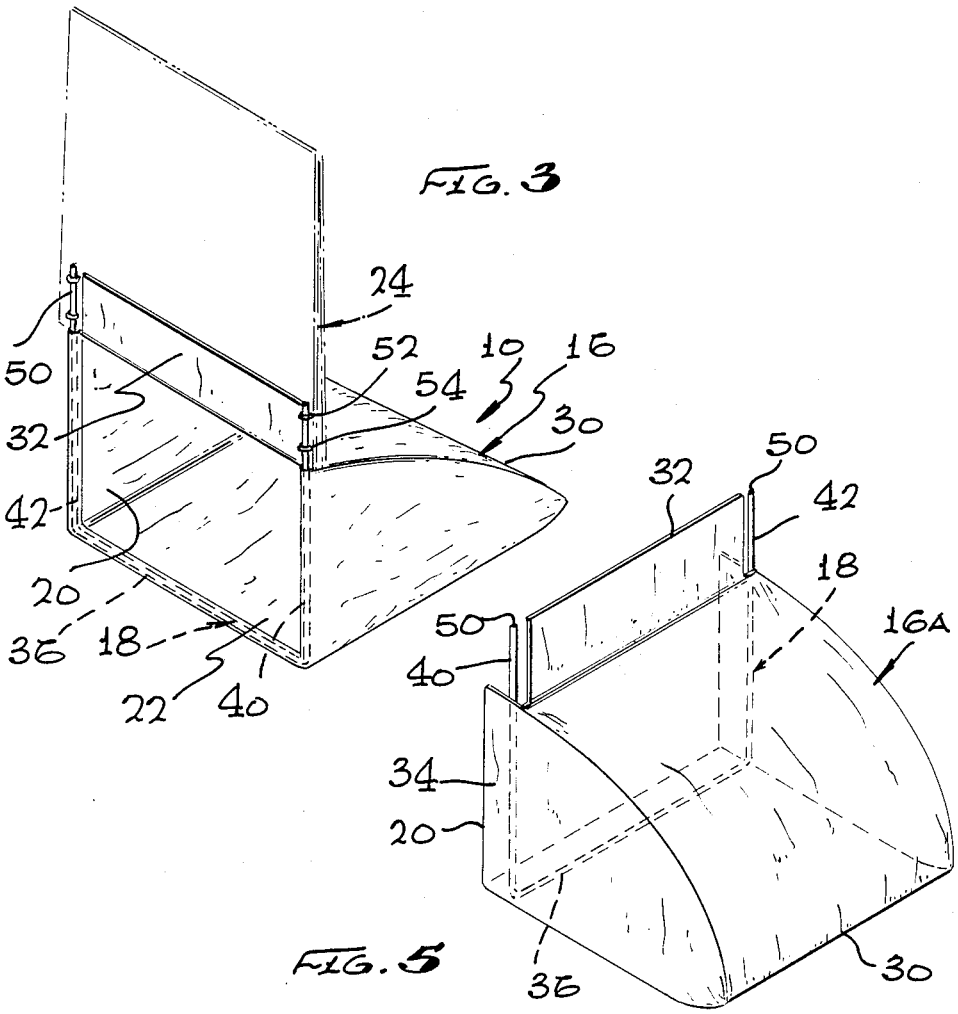
FIG. 5

FIG. 6
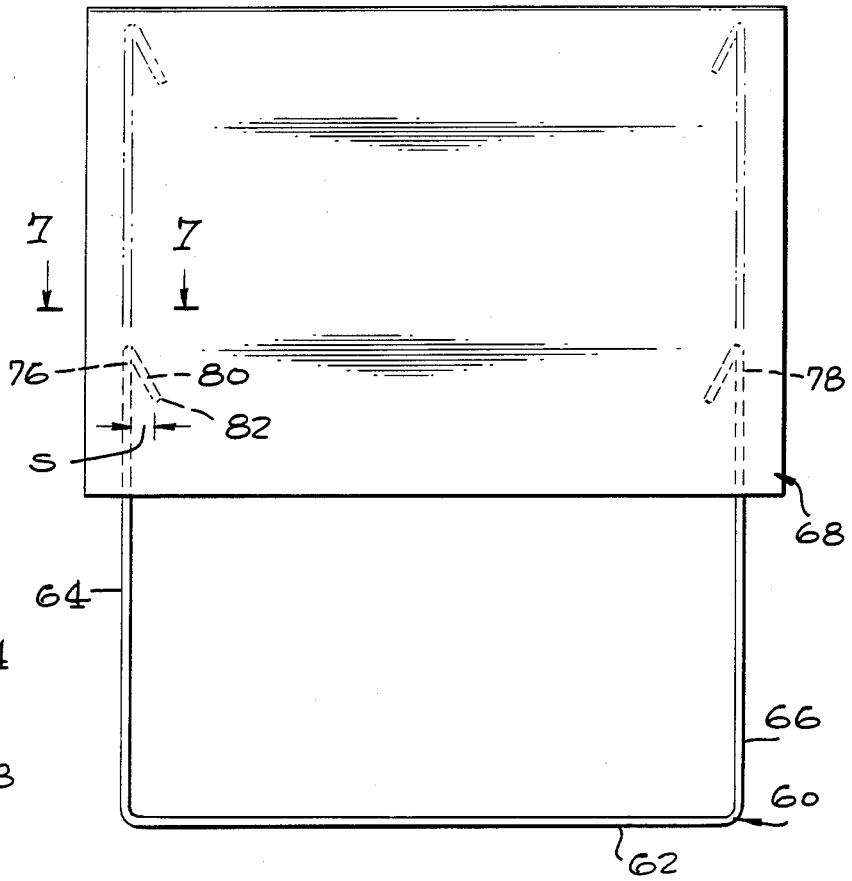
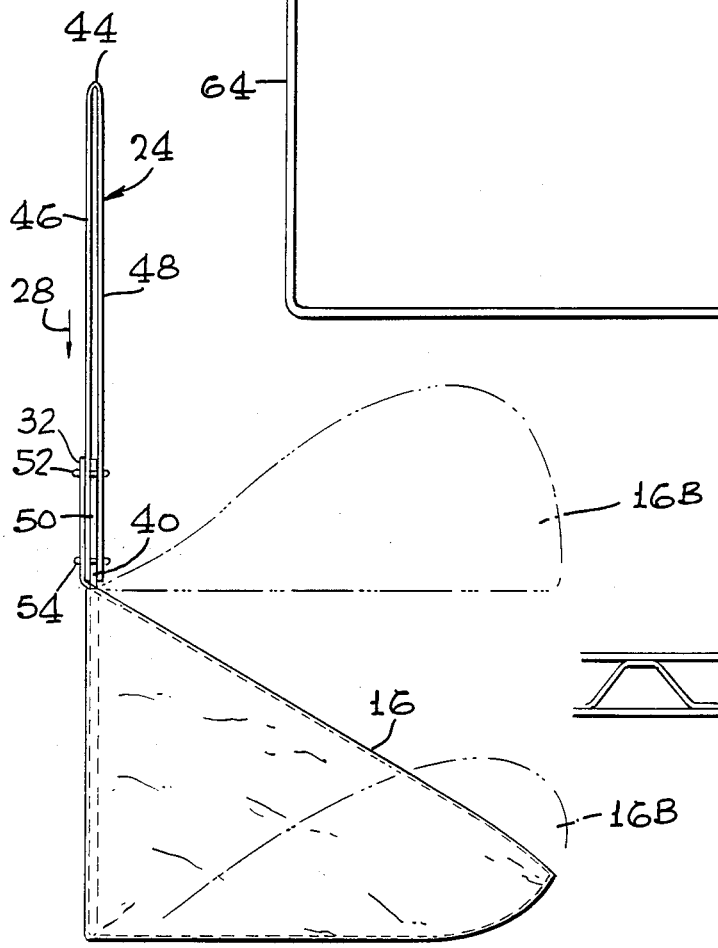
FIG. 4
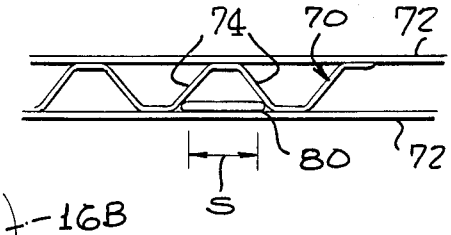
FIG. 7

DISPOSABLE WASTE SCOOPER

BACKGROUND OF THE INVENTION

The feces of animals, particularly dogs, can be removed by picking it off the ground with a scooper and then dumping the feces from the scooper into a disposable container such as a flexible plastic bag. It is often difficult to keep the opening of the flexible bag open, so that the waste may soil the hand of the person holding the bag open. Furthermore, if the scooper is not disposable, it is annoying to carry it with a portion of the waste still on it. A scooper device which enabled scooping up of waste off the ground directly into a low-cost disposable container, and the immediate closing of the container, all by action of a person whose hands are kept away from the waste, and with the device being of low cost so it can be economically disposed of, would be of considerable value.

SUMMARY OF THE INVENTION

In accordance with one embodiment of the present invention, a feces scooper is provided which facilitates scooping the feces into a bag, closing the bag, and disposing of the bag without bringing the operator close to the feces, all in a low-cost disposable apparatus. The feces scooper includes a frame, a closing device moveable with respect to the frame, and a flexible bag having an opening and walls around the opening that are mounted on the frame and closing device. The frame holds the bottom of the bag opening against the ground when scooping feces into the bag, and the frame then moves with respect to the closing device to close the bag. The combination of closed bag, frame, and closing device can be disposed of as a unit.

In one scooper, the frame is a wire bent in a U-shape, with the bag opening walls attached to the base and legs of the U. The legs of the U can slide vertically on a cardboard closing device. One side of the bag opening portion is attached to the cardboard closing device. The base of the U (covered by the bag opening walls) is scraped along the ground to scoop feces into the bag. The cardboard closing device is then pushed down to lower the attached side of the bag opening substantially against the base of the frame to close the bag. Since the cardboard closing device, wire frame, and flexible bag are all of low cost, they can be disposed of as a unit.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a feces scooper constructed in accordance with the present invention, showing it in an open position and as used to scoop up feces.

FIG. 2 is a partial perspective view showing the manner in which the scooper of FIG. 1 is closed.

FIG. 3 is a partial perspective view of the scooper of FIG. 1, showing its construction.

FIG. 4 is a side elevation view of the scooper of FIG. 3.

FIG. 5 is a rear perspective view of the scooper of FIG. 3, showing the bag prior to its installation on the frame.

FIG. 6 is a front view of a portion of another embodiment of the invention.

FIG. 7 is a view taken on the line 7—7 of FIG. 6.

DESCRIPTION OF THE PREFERRED EMBODIMENTS

FIG. 1 illustrates a feces scooper 10 for scooping a feces 12 such as from a dog, off the ground 14. The scooper includes a flexible bag 16 into which the feces is scooped, and a frame 18 which holds the opening 20 of the bag open and which can hold the bottom 22 of the bag opening closely against the ground to scoop the feces into the bag. The frame and bag are both mounted on a closing device 24. The closing device 24 can be directly held by a person to drag the bag along the ground, or an extension handle 26 can be attached to the closing device to avoid the necessity for a person to stoop or lean over to direclty hold the closing device. It can be seen that the closing device 24 is preferably oriented at an angle A from the vertical to drag the bottom of the bag opening along the ground.

FIG. 2 shows the manner in which the feces scooper is closed, after the feces 2 has been scooped into the bag 16. This is accomplished by orienting the closing device 24 more vertically and pressing it down in the direction of arrow 28. Such pressing causes closure of the bag at 16B. The closing device 24 can be pulled off the bottom of the extension 26, and the entire feces scooper (usually without the handle 26) can be disposed of as by dropping it into a garbage bag. The fact that the bag is closed greatly reduces the possibility of spillage of the feces and the attraction of flies. The fact that closure of the bag and subsequent holding of the bag before it is disposed of, occurs without a person directly handling the bag, avoids soiling of the person's hand by any feces that might lie near the bag opening.

FIGS. 3–5 illustrate details of the construction of the feces scooper 10. FIG. 5 shows the bag 16A just prior to its attachment to the frame 18. The bag can be a thin transparent plastic bag formed as a section of a tube of thin flexible plastic. One end 30 of the tube section is heat-sealed closed, while the other end forms the opening 20. The walls of the opening are preferably cut to leave a flap 32 at the top and a U-shaped flap 34 at the opposite sides and bottom of the frame 18. The frame 18 is formed from a length of wire bent into a U-shape, to form a base 36 at the bottom and a pair of upstanding legs 40, 42. The flap 34 at the bag opening is attached to the base and legs of the frame by wrapping them thereabout and fastening the wrapped portion as with adhesive.

As shown in FIG. 4, the closing device 24 is formed from a sheet of cardboard bent to form a fold 44 at the top of the closing device and a pair of walls 46, 48 extending downwardly therefrom. The upper end portions 50 of the wire frame lie between the cardboard walls of the closing device, and each upper end portion is slideably held in place by a pair of staples 52, 54, the staples also holding the cardboard walls together. In addition, the flap 32 at the top of the bag opening is attached to the rear wall 48 of the closing device.

As discussed above, after the feces is scooped into the bag 16, the closing device 24 is pushed down. During such downward pushing, the closing device 24 slides down along the legs 40, 42 of the wire frame. This brings the flap 32 at the top of the bag opening, towards the bottom 22 of the bag opening, to thereby close the bag. The upper and bottom bag opening portions 32, 22 can be referred to as opposite opening wall portions which can be brought together to close the bag. The closed bag is illustrated at 16B in FIG. 4. The fact that the lower portion 45 of the cover device lies close to the obttom 22 of the bag opening, also assures closure. There is a moderate friction between the legs of the wire frame and the cardboard walls 46, 48 between which they slide. This avoids downward sliding of the frame under the weight of the filled bag, which would open the bag after it had been closed. Accordingly, after the bag is closed, the closing device 24 can be used as a handle to lift the bag and carry it to a garbage bag into which the scooper is dropped.

The elements of the scooper, which comprise the plastic bag 16, bent wire frame 18, and cardboard closing device 24, can all be constructed and assembled at low cost. This enables the scooper to be used to scoop up feces and enables disposal of the scooper with the bag closed, at low cost. The extension handle 26 can be formed of a cardboard tube, and can be made either disposable or reusable. For re-use, the fact that the closing device 24 includes a folded-over cardboard sheet, facilitates friction holding of the top of the closing device 24 in a slot 56 formed at the bottom of the extension handle 26, while facilitating removal merely by pulling out the closing device.

FIGS. 6 and 7 illustrate a modified scooper construction which includes a bent wire frame 60 with a base 62 and legs 64, 66. The upper ends of the legs lie within a corrugated cardboard sheet 68 which includes a corrugated or multiple beam-like bracing structure 70 between a pair of face sheets 72. The bracing structure has multiple elongated beams 74 oriented to extend vertically, and the legs of the frame can slide vertically between the beams.

The upper ends 76, 78 of the legs form bent portions or hooks 80 extending at a downward angle. The separation S between the tip 82 of each hook and the middle of a leg is somewhat greater than the separation of the beams of the corrugated cardboard sheet. As a result, the tips provide an interference fit and friction against vertical sliding of the frame. Also, once the sheet 68 is pushed down, the tips 82 "dig" in and prevent the sheets (with the weight of material in the bag) from falling down.

Thus, the invention provides apparatus for scooping feces off the ground into a closeable container for holding the scooped feces, which permits scooping, closing of the bag, and disposal of the closed bag, all without the need for a person to bring his hand close to the feces or any residue that may lie at the bag opening. Furthermore, the apparatus can be constructed at low cost so it can be disposable, which is especially important because the apparatus has come in contact with waste which is objectionable to most people. This is accomplished by providing a flexible bag, a frame which holds the bag open and the bottom of the bag flat against the ground so it can scoop up feces into the bag. A closing device is moveable with respect to the frame, to enable closure of the bag without bringing the hand of the operator to the bag opening.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A disposable feces scooper apparatus for scooping feces off the ground, comprising:

a frame with a largely horizontal bottom which can be substantially scrapped along the ground;

a flexible bag having an opening and walls at said opening mounted on said frame including a bottom opening portion mounted on said frame bottom and an upper opening portion;

a closing device which is coupled to said upper opening portion of said bag and which is moveably mounted on said frame between an open position wherein said closing device lies above said frame bottom with said bag opening open and a closed position wherein said closing device is lowered to lie substantially against said bottom of said frame and closes said opening, said frame bottom being constructed so it can substantially abut the ground while the closing device is lowered.

2. The apparatus described in claim 1 wherein:

said frame is of largely U-shape, with the base of the U-shape forming said frame bottom and the legs of the U-shape slideable along their length on said closing device.

3. A disposable feces scooper for scooping feces off the ground, comprising:

a frame having a elongated lower portion which can substantially scrape along the ground and which extends substantially horizontally against the ground during use of the scooper, and having a pair of elongated legs extending largely vertically;

a flexible bag having an opening and lower walls at said opening attached to said frame lower portion, so when the lower portion of the frame is moved along the ground and under feces on the ground, the feces move into the bag;

a closing device which is slideably coupled to said legs to allow said closing device to slide down toward said lower frame portion when pushed towards it, said bag having upper walls at said opening which are positioned to be moved down as said closing device slides down, to close said bag opening.

4. The scooper described in claim 3 wherein:

said closing device has a lower portion closest to said lower frame portion; and said bag upper walls are attached to said closing device lower portion, whereby when the cover is slid down, opposite sides of the bag opening on said lower frame portion and on said closing device substantially come together to close the bag opening.

5. A disposable feces scooper apparatus for scooping feces off the ground, comprising:

a largely U-shaped frame with a largely horizontal base which can be substantially scrapped along the ground and a pair of legs;

a flexible bag having an opening and walls at said opening mounted on said frame including a bottom opening portion mounted on said frame base;

a closing device comprising a sheet of corrugated cardboard-like material having a plurality of largely vertically extending beams joining a pair of face sheets, said frame legs lying between said beams and slideable largely vertically therealong to allow the closing device to move between an open position wherein said closing device lies above said frame base and a closed position wherein said closing device is lowered to lie substantially against said frame base and close said bag opening, said frame base being constructed so it can substantially abut the ground while the closing device is lowered.

6. The apparatus described in claim 5 wherein:

at least one of said legs has an upper end lying in said sheet and bent by more than 90° to extend largely downwardly.

7. A disposable feces scooper apparatus for scooping feces off the ground, comprising:

a frame having a largely horizontal bottom which can be substantially scrapped along the ground, and having a pair of legs extending largely upwardly from opposite sides of said bottom;

a closing device which is slideably mounted on said frame between an open position wherein said closing device lies above said frame bottom and a closed position wherein said closing device is lowered to lie substantially against said bottom of said frame, said frame bottom being constructed so it can substantially abut the ground while the closing device is lowered;

a flexible bag having an opening and walls at said opening, said walls including portions mounted on said frame bottom, on said legs, and on a lower portion of said closing device.

8. A disposable feces scooper for scooping feces off the ground, comprising:

a frame having an elongated lower portion which extends horizontally substantially against the ground during use of the scooper, and having a pair of elongated legs extending largely vertically;

a flexible bag having an opening and walls at said pening attached to said lower portion and legs of said frame, so when the lower portion of the frame is moved along the ground and under feces on the ground, the feces move into the bag;

a closing device which slideably supports said legs to allow said closing device to slide down toward said lower frame portion when pushed towards it;

said closing device comprises a sheet of corrugated cardboard-like material having spaced vertical beams lying between a pair of face sheets, and said frame comprises a length of wire with said legs lying between said beams.

9. A disposable feces scooper comprising:

a bag having an opening and first and second opposite opening wall portions, said bag being flexible at least around said opening to enable said opposite wall portions to lie apart to open said opening and to be moved together to close said opening;

a frame having a lower portion that can substantially scrape along the ground, said first opening wall portion coupled to said frame lower portion so as the frame lower portion is substantially scraped along the ground with the bag opening open, feces is scooped into the bag;

a closing device moveable on said frame between open and closed positions, said second bag opening wall portion coupled to said closing device, so as the closing device moves towards said closed position it moves said second bag opening wall portion toward said first bag opening wall portion to close said bag opening.

10. The scooper described in claim 9 wherein:

said frame lower portion has a lower surface which is substantially straight and horizontal, and said bag first opening wall portion extends around said lower surface so said first wall portion contacts the ground as the frame lower portion substantially scrapes along the ground.

11. The scooper described in claim 9 wherein:

said frame comprises a bent wire having a middle forming said lower portion and having a pair of largely vertically extending walls slideably coupled to said closing device.

* * * * *